United States Patent [19]

Kobayashi

[11] Patent Number: 4,732,389

[45] Date of Patent: Mar. 22, 1988

[54] GOLF CLUB HEAD

[75] Inventor: Masashi Kobayashi, Matsudo, Japan

[73] Assignee: Maruman Golf Co., Ltd., Tokyo, Japan

[21] Appl. No.: 934,593

[22] Filed: Nov. 25, 1986

[30] Foreign Application Priority Data

Nov. 29, 1985 [JP] Japan ..... 60-182908[U]

[51] Int. Cl.[4] ..... A63B 53/04

[52] U.S. Cl. ..... 273/169; 273/174

[58] Field of Search ..... 273/169, 171, 173, 167 F, 273/172, 174

[56] References Cited

U.S. PATENT DOCUMENTS

| | | | |
|---|---|---|---|
| 1,524,488 | 1/1925 | Read | 273/169 |
| 3,659,855 | 5/1972 | Hardesty | 273/173 |
| 4,498,672 | 2/1985 | Bulla | 273/169 |

FOREIGN PATENT DOCUMENTS

| | | | |
|---|---|---|---|
| 440379 | 12/1935 | United Kingdom | 273/171 |

*Primary Examiner*—George J. Marlo
*Attorney, Agent, or Firm*—Armstrong, Nikaido, Marmelstein & Kubovcik

[57] ABSTRACT

A golf club head for a wood type club comprises a head body (11) having a face for hitting a golf ball, the face being inclined upward and backward. A face plate (12) is provided in the face of the head body (11), and a sole plate (13) is provided in the backside of the head body (11). A bar-shaped weight (18) is provided in the head body (11) and extends substantially perpendicular to the face from the backside of the face plate toward the backside of the head body (11) so that the longitudinal axis of the bar-shaped weight (18) passes through the central portion of the face of the head body (11). A back weight (19) is provided in the backside of the head body (11) so that the line connecting the center of gravity of the golf club head (11) and the sweet spot thereof coincides with the longitudinal axis of the bar-shaped weight (18).

6 Claims, 6 Drawing Figures

GOLF CLUB HEAD

BACKGROUND OF THE INVENTION

1. Field of the Invention

The present invention relates to a golf club head for a wood type club and, more specifically, to a golf club head capable of increasing the distance of flight of the ball and enabling the player to hit the ball so that the ball will fly in the desired direction.

2. Description of the Related Arts

Generally, golf clubs, particularly, wood type golf clubs for obtaining a long flight distance of a golf ball, should be able to make the ball fly as far as possible. Since the correct control of the direction of flight of the ball results in an increase in the distance of flight of the ball, a golf club capable of enabling the player to hit the ball so that the ball will fly in the desired direction is desirable. In order to enhance the performance of the golf club, it is important to locate the sweet spot of the head, namely, the point of intersection at the face of a perpendicular line drawn between the center of gravity and the face, is located as near to the center of the face as possible by locating the center of gravity as low as possible, to concentrate the weight of the head as much as possible around the line connecting the center of gravity and the sweet spot of the head, and to increase the moment of inertia about the center of gravity of the head by locating the center of gravity of the head as near as possible to the backside of the head, to increase the depth of the center of gravity, namely, the distance from the center of gravity to the face.

Note, various attempts have been made to enhance the distance of flight of the ball and to improve the capability of the club to enable the player to make the ball fly in the desired direction.

Japanese Unexamined Utility Model Publication No. 58-182,765 discloses a golf club head comprising a head body provided with recesses formed in the face and sole thereof, respectively, and a hole formed so as to interconnect the recesses, characterized by a face plate, a sole plate, and a connecting part interconnecting the face plate and the sole plate which are formed integrally by filling the recesses and the hole with a hard filling material. The constitution of this golf club head is intended to enhance the repulsion characteristic of the golf club head. However, since the face plate, the sole plate, and the connecting part formed in the hole are formed integrally of the same material, the depth of the center of gravity is inevitably small even if the filling material has a comparatively large specific gravity, and hence the ball directing performance of the golf club head is deteriorated. Furthermore, integrally forming the face plate, the sole plate and the connecting part with the same material unavoidably raises the position of the center of gravity, and accordingly the sweet spot is located above the center of the face, whereas the connecting part extends backward from a position on the face below the center of the face. Therefore, the longitudinal axis of the connecting part does not coincide with the line interconnecting the sweet spot and the center of gravity, and hence the connecting part is unable to provide a sufficient mass effect, namely, repulsion characteristic. Accordingly, this golf club head is not expected to greatly increase the distance of flight of the ball.

Japanese Examined Utility Model Publication No. 54-43,790 discloses a golf club head comprising a high-resistance connective member horizontally extending backward from the backside of the face plate, and a side sole joined to the rear end of the connective member with a connective bar. Since the side sole is in the rear part of the head, the depth of the center of gravity of this golf club head is large. However, since the connective member does not extend perpendicularly to the face and the front end of the connective member is not located at the center of the face, the longitudinal axis of the bar-shaped weight does not coincide with the line interconnecting the center of gravity and the sweet spot of the head, and hence the golf club head is unable to provide a sufficient mass effect, namely, repulsion characteristic. Accordingly, this golf club head is not expected to greatly increase the distance of flight of the ball.

Japanese Examined Utility Model Publication No. 49-12,116 discloses a golf club head comprising a bar-shaped weight extending backward perpendicular to and substantially from the center of the face, and a nut-shaped weight joined to the rear end of the bar-shaped weight. In this golf club head, the bar-shaped weight has a flange-shaped head fitting a counterbore formed in the face plate, and the head of the bar-shaped weight is exposed. Therefore, the depth of the center of gravity of this golf club head is small, and hence the ball directing performance of this golf club head is not satisfactory. That is, the direction of the face of a golf club head having a small depth of the center of gravity is liable to deviate from the correct direction when a part other than the sweet spot hits against the ball; consequently, the ball directing performance of this golf club head is not satisfactory.

SUMMARY OF THE INVENTION

The present invention provides a golf club head for a wood type club, comprising:

a head body having a face for hitting a golf ball, the face being inclined upward and backward;

a face plate provided in the face of the head body;

a sole plate provided in the backside of the head body;

a bar-shaped weight provided in the head body and extending substantially perpendicular to the face from the backside of the face plate toward the backside of the head body so that the longitudinal axis of the bar-shaped weight (18) passes through the central portion of the face of the head body (11); and a back weight provided in the backside of the head body so that the line connecting the center of gravity of the golf club head and the sweet spot thereof coincides with the longitudinal axis of the bar-shaped weight.

In the golf club head according to the present invention, the sweet spot is located substantially at the center of the face, the depth of the center of gravity is large, and the weight of the head is concentrated on the line connecting the center of gravity and sweet spot of the head. Consequently, the golf club head according to the present invention can increase the distance of flight of the ball and is capable of providing an improved ball directing performance.

BRIEF EXPLANATION OF THE DRAWINGS

The foregoing and other objects and advantages of the present invention will be better understood from the following description with reference to the preferred embodiments illustrated in the drawings; wherein.

DESCRIPTION OF THE PREFERRED EMBODIMENTS

Figure 1:
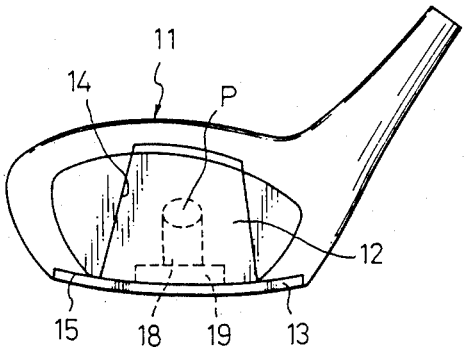
FIG. 1 is a front elevation of a golf club head, in a first embodiment, according to the present invention.
Figure 2:
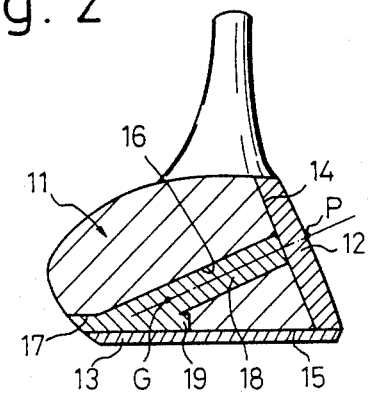
FIG. 2 is a longitudinal sectional view of the golf club head shown in FIG. 1.
Figure 3:
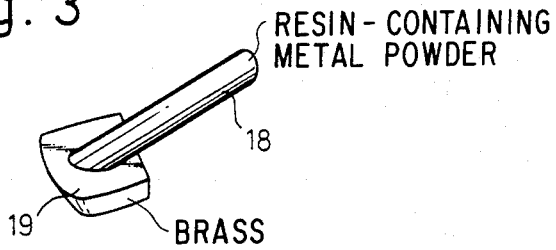
FIG. 3 is a perspective view of weights applied to the golf club head shown in FIG. 1.

FIGS. 1 to 3 illustrate a first embodiment of the present invention.

Referring to FIGS. 1 and 2, a golf club head for a wood type club comprises a head body 11, a face plate 12, and a sole plate 13. The head body 11 may be formed of wood, a resin, a light metal or a carbon fiber reinforced resin. The face plate 12 may be formed of a resin, a light metal or a carbon fiber reinforced resin. The sole plate 13 may be formed of aluminum, brass or a stainless steel. The face plate 12 is fixedly fitted in a recess 14 formed in the front surface of the head body 11, and the sole plate 13 is fixedly fitted in a recess 15 formed in the bottom surface of the head body 11.

A hole 16 is formed in the head body 11 so as to extend substantially perpendicular to the face from the backside of the face plate 12 toward the backside of the head body 11 so that the longitudinal axis of the hole 16 passes through the central portion of the face. The hole 16 opens into a counterbore 17 formed in the back of the head body 11. A bar-shaped weight 18 is fixedly fitted in the hole 16, and a weight adjusting member, namely, a back weight 19, formed integrally with the bar-shaped weight 18 is fixedly fitted in the counterbore 17. The back weight 19 is provided along a recess 15 so that the line connecting the center of gravity G of the head and the sweet spot P of the head coincide substantially with the longitudinal axis of the bar-shaped weight 18. The lower surface of the back weight 19 is covered with the sole plate 13.

The bar-shaped weight 18 and the back weight 19 may be formed of brass, aluminum, or a resin-containing metal powder, such as brass powder, or lead. The bar-shaped weight 18 and the back weight 19 may be formed beforehand in a unitary body as illustrated in FIG. 3, and then inserted into and secured to the hole 16 and the counterbore 17. When the bar-shaped weight 18 and the back weight 19 are formed of a resin-containing metal powder, or of lead, the resin may be poured into the hole 16 and the counterbore 17 after attaching the face plate 12 to the head body 11 to form the bar-shaped weight 18 and the back weight 19 in the head body 11.

In the golf club head thus constructed, the bar-shaped weight 18 extends substantially perpendicular to the face from the backside of the face plate 12 toward the backside of the head body 11 so that the longitudinal axis of the bar-shaped weight 18 passes through the central portion of the face, and the back weight 19 is provided in the backside of the head body 11 so that the line connecting the center of gravity G of the head and the sweet spot P of the head coincides with the longitudinal axis of the bar-shaped weight 18. Accordingly, the sweet spot P is located substantially at the center of the face, the depth of the center of gravity is large, and the weight of the head is concentrated on the line connecting the center of gravity G of the head and the sweet spot P of the head. Since the sweet spot P is located substantially at the center of the face, it is easy to make the sweet spot P hit against the ball, thus increasing the distance of flight of the ball. Furthermore, when the golf club head hits against the ball, the mass effect of the bar-shaped weight 18 and the back weight 19 applies a great repulsion to the ball, which increases the distance of flight of the ball. Still further, since the depth of the center of gravity is large, the golf club head has a large moment of inertia about the center of gravity, and hence the direction of the face is less liable to change at the moment of impact of the face against the ball even if the face hits against the ball at a position deviated from the sweet spot. Thus, the golf club head is capable of a satisfactory ball directing performance, and consequently, the distance of flight of the ball is increased.

In this embodiment, since the lower surface of the back weight 19 is covered with the sole plate 13, the head sole is protected from damage and abrasion by the sole plate 13 formed of a hard material even if the back weight 19 is formed of a comparatively soft material.

Figure 4:
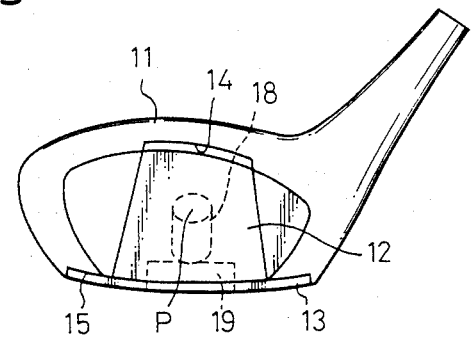
FIG. 4 is a front elevation of a golf club head, in a second embodiment, according to the present invention.
Figure 5:
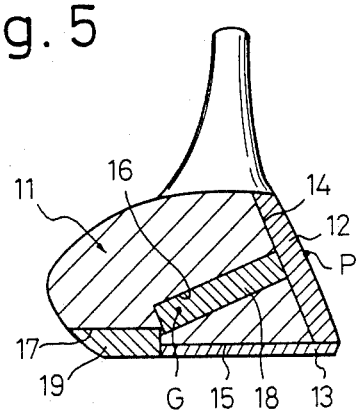
FIG. 5 is a longitudinal sectional view of the golf club head shown in FIG. 4.
Figure 6:
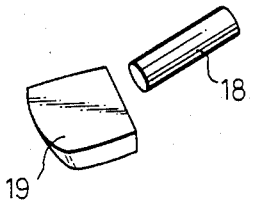
FIG. 6 is a perspective view of weights applied to the golf club head shown in FIG. 4.

FIGS. 4 to 6 illustrate a second embodiment of the present invention. Note, in FIGS. 1 to 6, like reference characters designate like or corresponding parts throughout.

The second embodiment is provided with a bar-shaped weight 18 and a back weight 19, which are formed individually. The bar-shaped weight 18 is placed fixedly in a bottomed hole 16 formed in a head body 11.

The bar-shaped weight 18 and the back weight 19 may be formed of the same material or different materials, respectively. Accordingly, the bar-shaped weight 18 and the back weight 19 can be formed of optimum materials meeting the respective functions, and hence the adjustment of the position of the center of gravity of the head and the weight of the head by means of the back weight 19 is further facilitated.

Although the invention has been described with reference to the preferred embodiments illustrated in the accompanying drawings, the present invention is not limited thereto in application. For example, it is possible to form a further recess in the head body at an optional position and to bury another weight adjusting body therein to adjust the total weight of the golf club head.

I claim:

1. A golf club head for a wood type club, comprising:

a head body having a front surface inclined upward and backward;

a face plate having a face for hitting a golf ball provided in said front surface of said head body;

a sole plate provided at the bottom of said head body;

a bar-shaped weight provided in said head body and having a longitudinal axis extending from a central portion of the backside of said face plate toward a backside of said head body, said longitudinal axis of said bar-shaped weight being substantially perpendicular to a central portion of said face of said face plate; and a back weight provided in said backside of said head body to establish a center of gravity of said golf club head in a position such that a line connecting said center of gravity of said golf club head an a sweet spot thereof coincides with said longitudinal axis of said bar-shaped weight.

2. A golf club head according to claim 1, wherein said bar-shaped weight and said back weight are formed as a unitary member.

3. A golf club head according to claim 1, wherein said bar-shaped weight and said back weight are formed individually and are secured to said head body.

4. A golf club head according to claim 1 or 3, wherein said bar-shaped weight is formed of a resin-containing metal powder, and said back weight is formed of brass.

5. A golf club head according to claim 4, wherein a lower surface of said back weight is covered with said sole plate.

6. A golf club head according to any one of claim 1 to 3, wherein a lower surface of said back weight is covered with said sole plate.

* * * * *